US009072640B2

(12) United States Patent
Wu

(10) Patent No.: US 9,072,640 B2
(45) Date of Patent: Jul. 7, 2015

(54) SUSPENSION STRUCTURE FOR AN ELECTRIC WHEELCHAIR

(71) Applicant: Energy Control Limited, Tortola (VG)

(72) Inventor: Donald P. H. Wu, Hsin-Feng Hsiang (TW)

(73) Assignee: Energy Control Limited, Road Town (VG)

( * ) Notice: Subject to any disclaimer, the term of this patent is extended or adjusted under 35 U.S.C. 154(b) by 0 days.

(21) Appl. No.: 14/454,402

(22) Filed: Aug. 7, 2014

(65) Prior Publication Data

US 2015/0107917 A1 Apr. 23, 2015

(30) Foreign Application Priority Data

Oct. 22, 2013 (TW) ..... 102138032 U

(51) Int. Cl.

*A61G 5/06* (2006.01)
*A61G 5/04* (2013.01)
*A61G 5/10* (2006.01)

(52) U.S. Cl.

CPC *A61G 5/06* (2013.01); *A61G 5/043* (2013.01); *A61G 2005/1078* (2013.01); *A61G 2005/1086* (2013.01); *A61G 2005/1089* (2013.01)

(58) Field of Classification Search

CPC . A61G 5/043; A61G 5/06; A61G 2005/1078; A61G 2005/1086; A61G 2005/1089
See application file for complete search history.

(56) References Cited

U.S. PATENT DOCUMENTS

| | | | | |
|---|---|---|---|---|
| 6,923,278 | B2 * | 8/2005 | Mulhern et al. | 180/65.1 |
| 8,408,598 | B2 | 4/2013 | Mulhern et al. | |
| 2005/0151360 | A1 * | 7/2005 | Bertrand et al. | 280/755 |
| 2007/0114079 | A1 | 5/2007 | Chao | |
| 2008/0083573 | A1 | 4/2008 | Tseng | |
| 2011/0253464 | A1 | 10/2011 | Chen | |
| 2012/0080244 | A1 | 4/2012 | Hou | |

FOREIGN PATENT DOCUMENTS

TW M374415 U1 2/2010

OTHER PUBLICATIONS

GB Search report of corresponding TW application.

* cited by examiner

*Primary Examiner* — Drew Brown
(74) *Attorney, Agent, or Firm* — Wang Law Firm, Inc.; Li K. Wang; Stephen Hsu

(57) ABSTRACT

A simply structured suspension structure for an electric wheelchair includes a frame, two drive units, two front guide units, two front shock absorbers, two anti-roll units, and two rear shock absorbers. The two front guide units are located at both sides of the frame and each include a front guide wheel, a front suspension arm and a torsion spring. The two front and rear shock absorbers are connected to the frame. The two anti-roll units are located at both sides of the frame. When the front guide arms drive the front guide wheels to pivot, the torsion springs can produce a reaction force to prevent the frame from rolling over, improving safety. When the suspension structure runs across an uneven bumpy road, the front and rear shock absorbers can ease the shock imposed on the frame, enhancing sitting comfort.

3 Claims, 8 Drawing Sheets

SUSPENSION STRUCTURE FOR AN ELECTRIC WHEELCHAIR

CROSS REFERENCE TO RELATED APPLICATION

This application claims the benefit of priority to TW 102138032, filed on Oct. 22, 2013 with the Intellectual Property Office of the Republic of China, Taiwan, the entire specification of which is incorporated herein by reference.

BACKGROUND OF THE INVENTION

1. Field of the Invention

The present invention relates to a suspension structure, and more particularly to a suspension structure for an electric wheelchair.

2. Description of the Prior Art

A conventional electric wheelchair disclosed in Taiwan Utility Model Registration number M374415 U1 generally comprises a frame connected with a small front wheel, a big front wheel, and a small rear wheel. Between the frame and the small front wheel are connected a connecting member, a shock absorber and a front arm. The connecting member is pivoted to the frame, the front arm is pivoted to the connecting member, the shock absorber is connected between the connecting member and the front arm, and the big front wheel is connected to a motor and the front arm. A rear arm is connected to the small rear wheel and pivoted to the frame, and between the frame and the rear arm is also connected a shock absorber. The shock absorbers can reduce shocks and enhance sitting comfort, when the small front and rear wheels run across bumpy roads. However, this conventional suspension structure of the electric wheelchair is very complicated and difficult to assemble, and complicated structure further reduces the structural strength of the suspension structure. Besides, the conventional suspension structure only provides shock absorbing effect but is unable to prevent rollover.

Another conventional suspension structure for an electric wheelchair disclosed in U.S. Pat. No. 8,408,598 has been simplified in structure, but is still unable to prevent rollover.

The present invention has arisen to mitigate and/or obviate the afore-described disadvantages.

SUMMARY OF THE INVENTION

The primary objective of the present invention is to provide a simply structured suspension structure for an electric wheelchair which is easy to assemble, and capable of enhancing sitting comfort and safety of the wheelchair.

To achieve the above objective, a suspension structure for an electric wheelchair in accordance with the present invention, comprises: a frame with an upper side, a lower side, a front end and a rear end, a chair seat mounted on the upper side, a direction extending from the front end to the rear end being defined as a first direction, and a direction perpendicular to the first direction being defined as a second direction; two drive units located at both sides of the frame and each including a bogie and a transmission device fixed to the bogie, one end of each of the bogies being pivoted to the frame via a transmission pivot unit, and each of the transmission devices extending toward another end of each of the bogies, the suspension structure is characterized in that:

each of the bogies is further provided with an assembling section extending along in the second direction;

two drive wheels are connected to and rotated by the transmission devices;

two front guide units are located at both sides of the frame and each include a front guide wheel, a front suspension arm and a torsion spring, the front guide wheels are pivoted to one end of the front suspension arms, respectively, and another end of each of the front suspension arms is pivoted to the frame via a front suspension arm pivot shaft and located close to the front end, each of the torsion springs is sleeved onto the front suspension arm pivot shaft and has one end fixed to the second front extension section and another end abutted against the lower side close to the front end of the frame;

two front shock absorbers each have one end pivoted between the two ends of each of the front suspension arms and another pivoted to the assembling section of each of the bogies, and extend in a direction which has an angle with respect to the first direction;

two anti-roll units are located at both sides of the frame and each include an anti-roll wheel and a rear suspension arm, each of the anti-roll wheels is pivoted to one end of each of the rear suspension arms, and another end of each of the rear suspension arms is pivoted to the frame via a rear suspension arm pivot shaft; and two rear shock absorbers each have one end pivoted between two ends of each of the rear suspension arms and another end pivoted to the frame, and extend in a direction which has an angle with respect to the first direction.

DETAILED DESCRIPTION OF THE PREFERRED EMBODIMENTS

Figure 1:
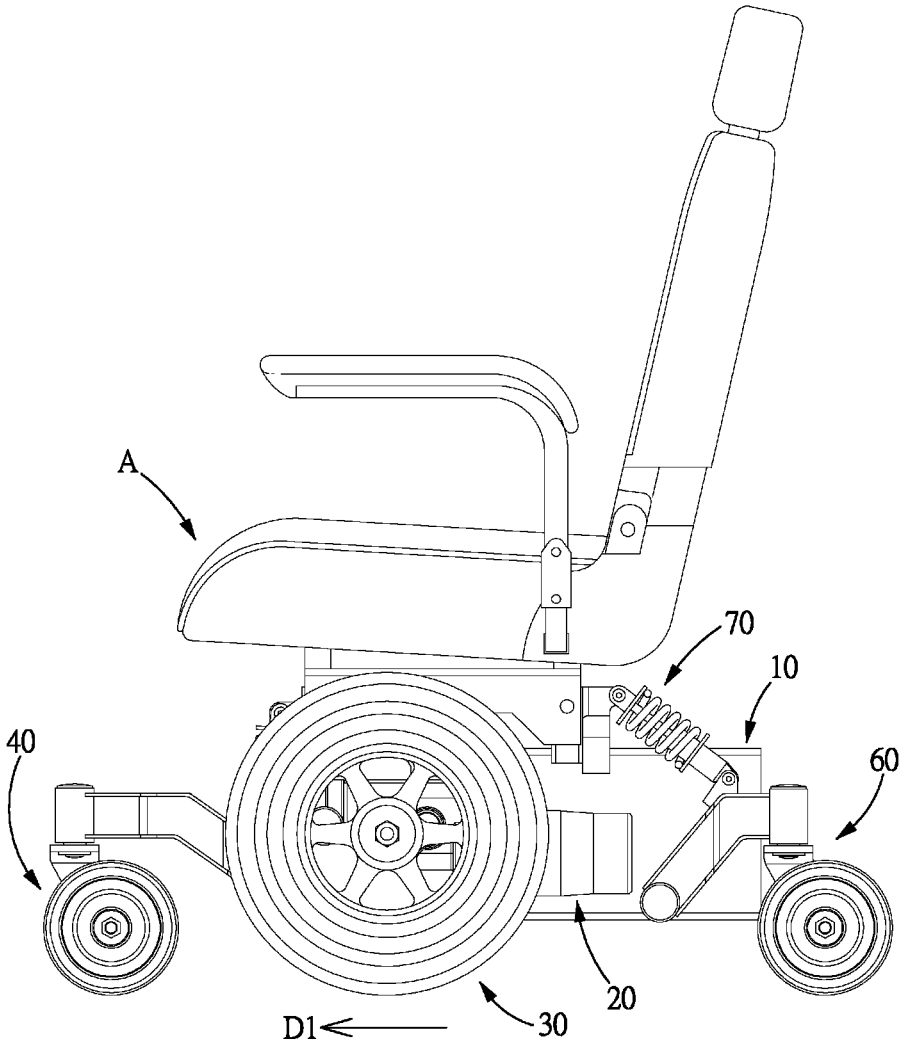
FIG. 1 shows that a suspension structure for an electric wheelchair in accordance with a preferred embodiment of the present invention is assembled on the electric wheelchair.
Figure 2:
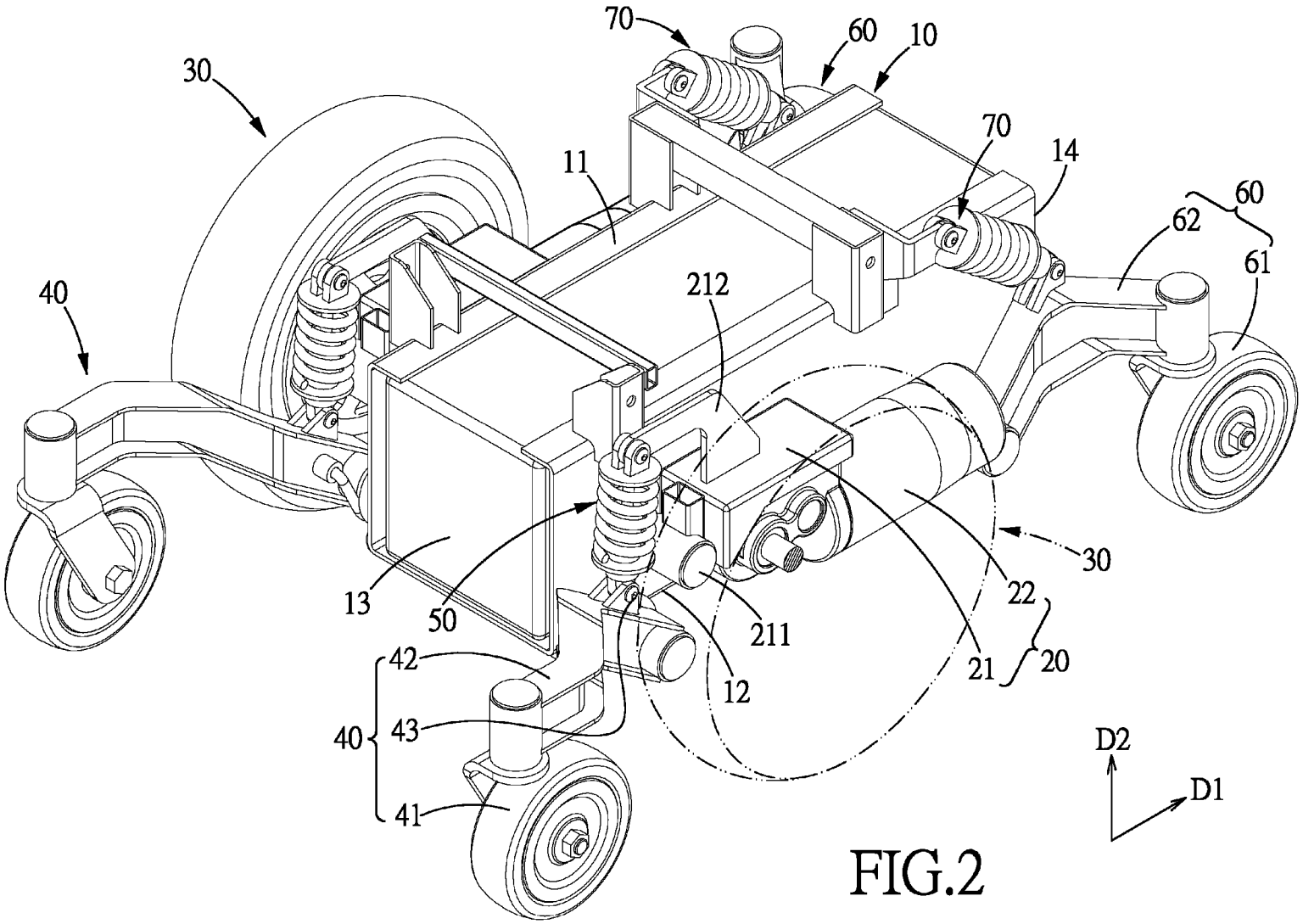
FIG. 2 is a perspective view of the suspension structure for the electric wheelchair in accordance with the present invention.
Figure 3:
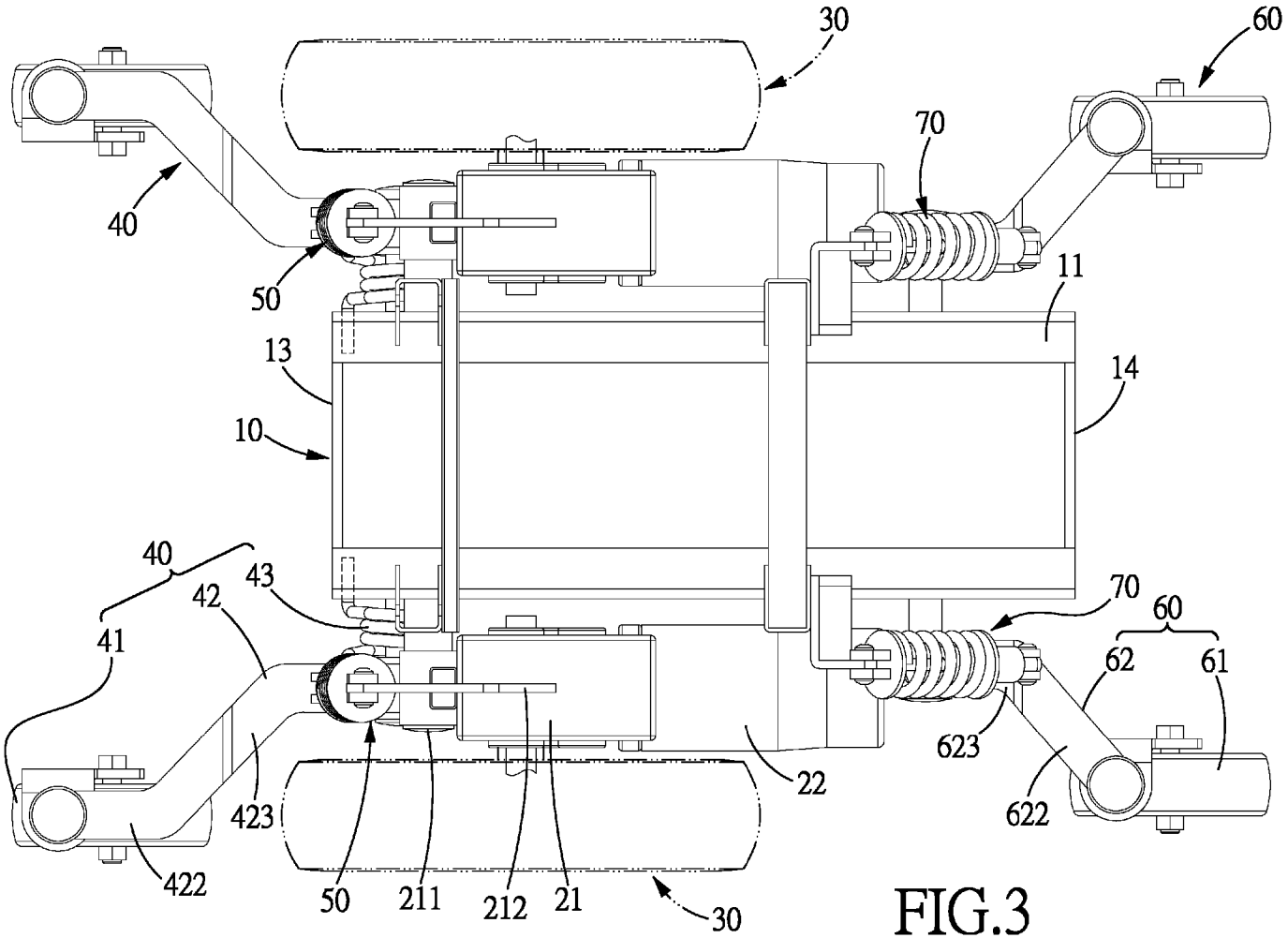
FIG. 3 is a top view of the suspension structure for the electric wheelchair in accordance with the present invention.
Figure 4:
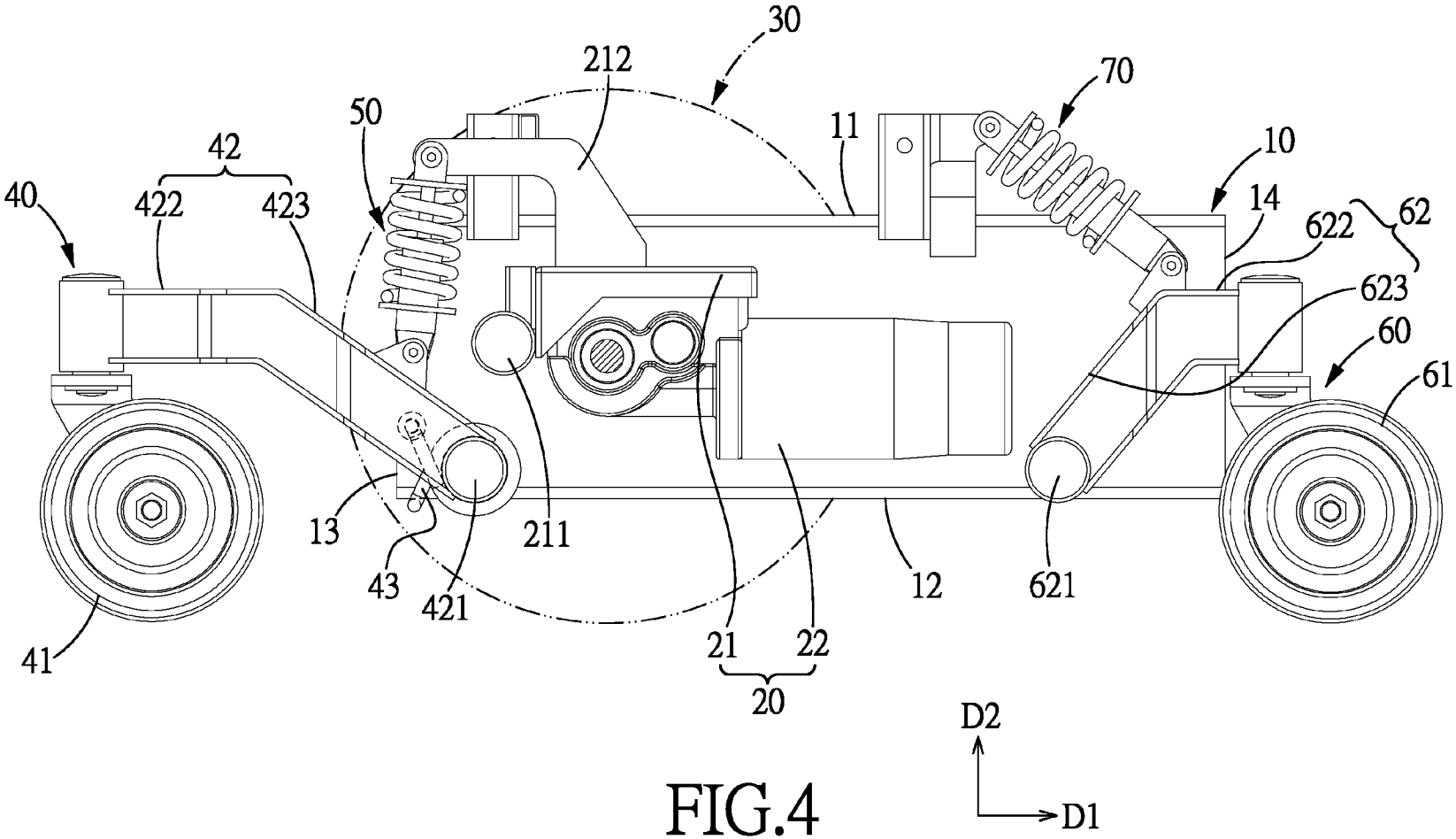
FIG. 4 is a cross sectional view of the suspension structure for the electric wheelchair in accordance with the present invention.
Figure 5:
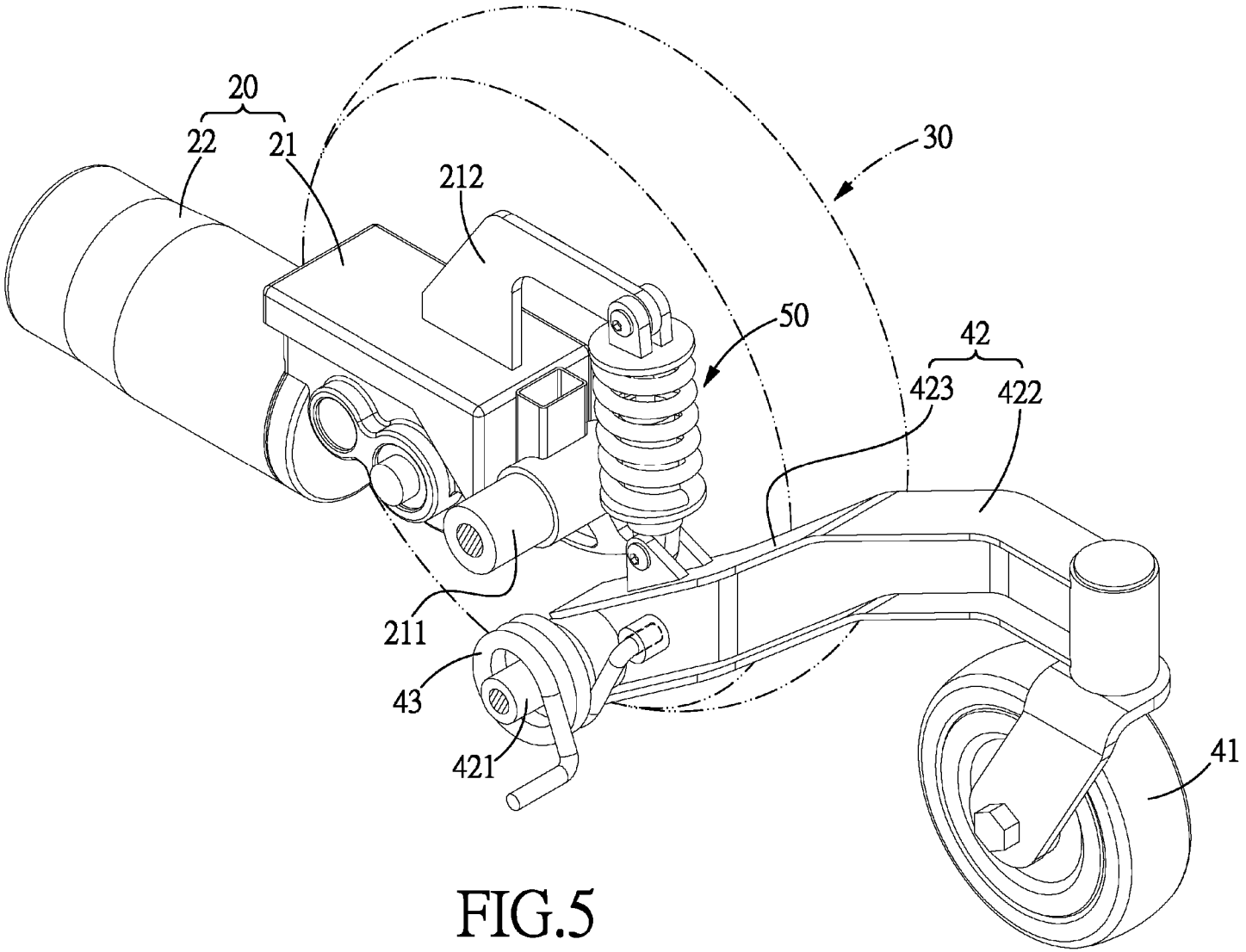
FIG. 5 shows the transmission unit, the front guide unit and the front shock absorber of the suspension structure for the electric wheelchair in accordance with the present invention.

The present invention will be clearer from the following description when viewed together with the accompanying drawings, which show, for purpose of illustrations only, the preferred embodiment in accordance with the present invention.

Referring to FIGS. 1-8, a suspension structure for an electric wheelchair in accordance with a preferred embodiment of the present invention comprises: a frame 10, two drive units 20, two drive wheels 30, two front guide units 40, two front shock absorbers 50, two anti-roll units 60, and two rear shock absorbers 70.

The frame 10 includes an upper side 11, a lower side 12, a front end 13 and a rear end 14. A chair seat A is mounted on the upper side 11. A direction extending from the front end 13 to the rear end 14 is defined as a first direction D1, and a direction which is perpendicular to the first direction D1 is defined as a second direction D2.

The two drive units 20 are located at both sides of the frame 10 and each include a bogie 21 and a transmission device 22 fixed to the bogie 21. One end of each of the bogies 21 is pivoted to the frame 10 via a transmission pivot unit 211, and each of the transmission devices 22 extends toward another end of each of the bogies 21. Each of the bogies 21 is further provided with an assembling section 212 extending along in the second direction D2.

The two drive wheels 30 are connected to and rotated by the transmission devices 22.

The two front guide units 40 are located at both sides of the frame 10 and each include a front guide wheel 41, a front suspension arm 42 and a torsion spring 43. The front guide wheels 41 are pivoted to one end of the front suspension arms 42, respectively, and another end of each of the front suspension arms 42 is pivoted to the frame 10 via a front suspension arm pivot shaft 421 and located close to the front end 13. Between the two ends of each of the front suspension arms 42 is formed a first front extension section 422 and a second front extension section 423. In this embodiment, the first front extension section 422 is a flat and straight section extending along the first direction D1, and the second front extension section 423 is an oblique section which extends toward the lower side 12 and defines a first angle with respect to the first direction D1. Each of the torsion springs 43 is sleeved onto the front suspension arm pivot shaft 421 and has one end fixed to the second front extension section 423 and another end abutted against the lower side 12 close to the front end 13 of the frame 10.

Each of the two front shock absorbers 50 has one end pivoted between the two ends of each of the front suspension arms 42 and another pivoted to the assembling section 212 of each of the bogies 21, and extends in a direction which has a second angle with respect to the first direction D1.

The two anti-roll units 60 are located at both sides of the frame 10 and each includes an anti-roll wheel 61 and a rear suspension arm 62. The anti-roll wheel 61 is pivoted to one end of the rear suspension arm 62, and another end of the rear suspension arm 62 is pivoted to the frame 10 via a rear suspension arm pivot shaft 621. Between two ends of each of the rear suspension arms 62 are formed a first rear extension section 622 and a second rear extension section 623. The first rear extension section 622 is straight and flat section extending in the first direction D1, and the second rear extension section 623 is an oblique section which extends toward the lower side of the frame and has a third angle with respect to the first direction D1.

The two rear shock absorbers 70 each have one end pivoted between two ends of each of the rear suspension arms 62 and another end pivoted to the frame 10, and extend in a direction which has a fourth angle with respect to the first direction D1.

Figure 6:
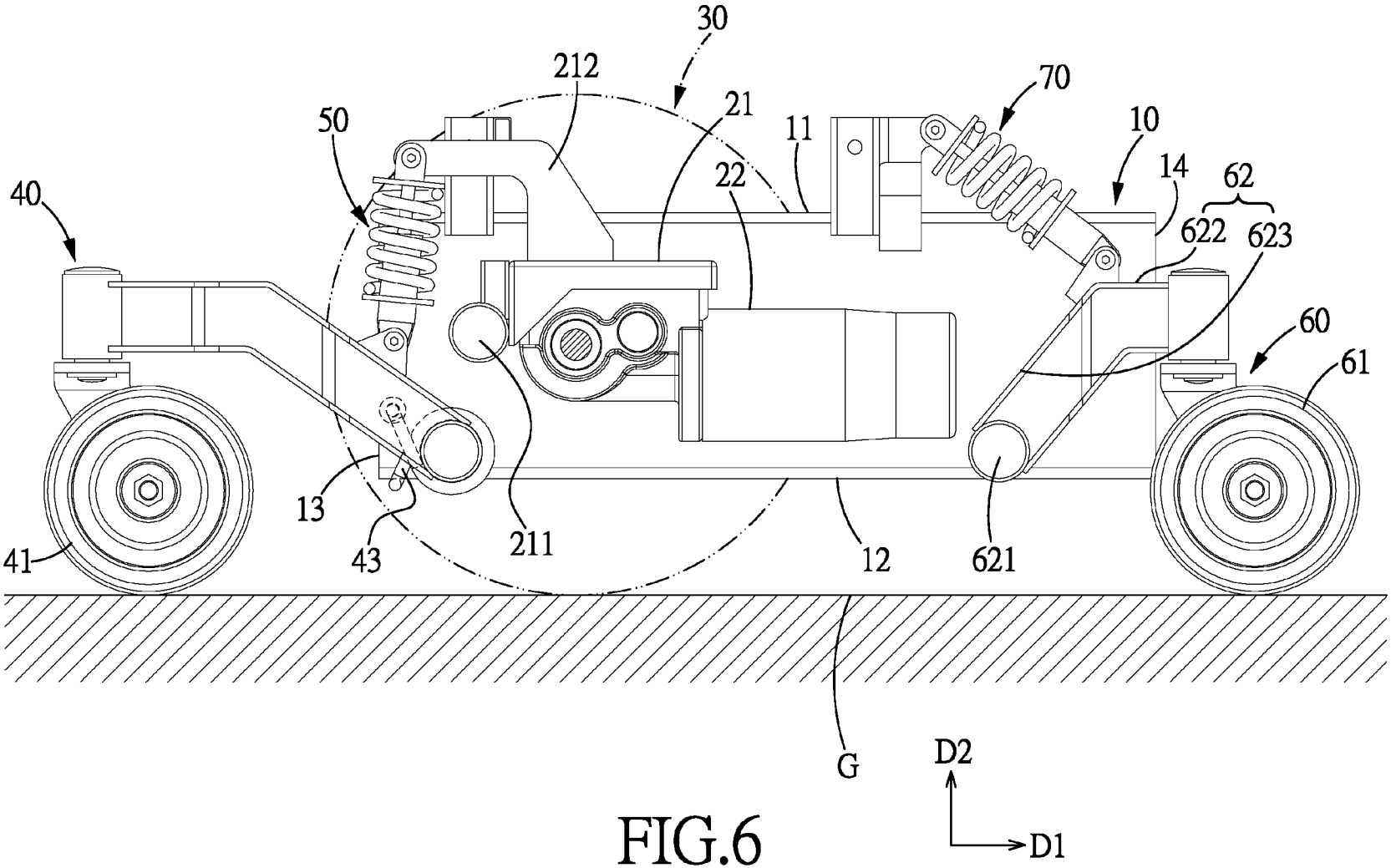
FIG. 6 shows that the suspension structure for the electric wheelchair in accordance with the present invention is placed on a flat bearing surface.
Figure 7:
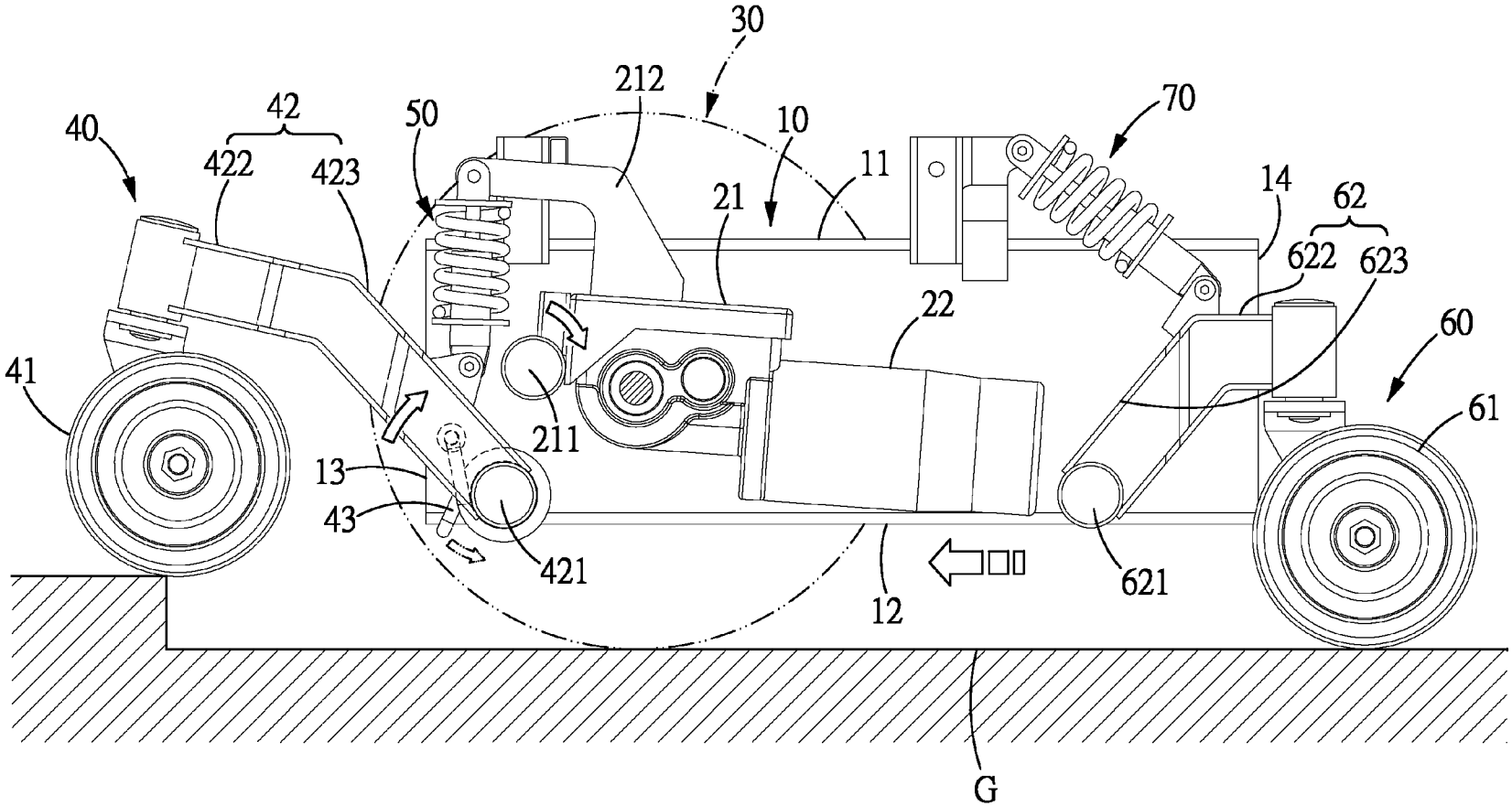
FIG. 7 shows that the suspension structure for the electric wheelchair in accordance with the present invention is climbing a convex obstacle.
Figure 8:
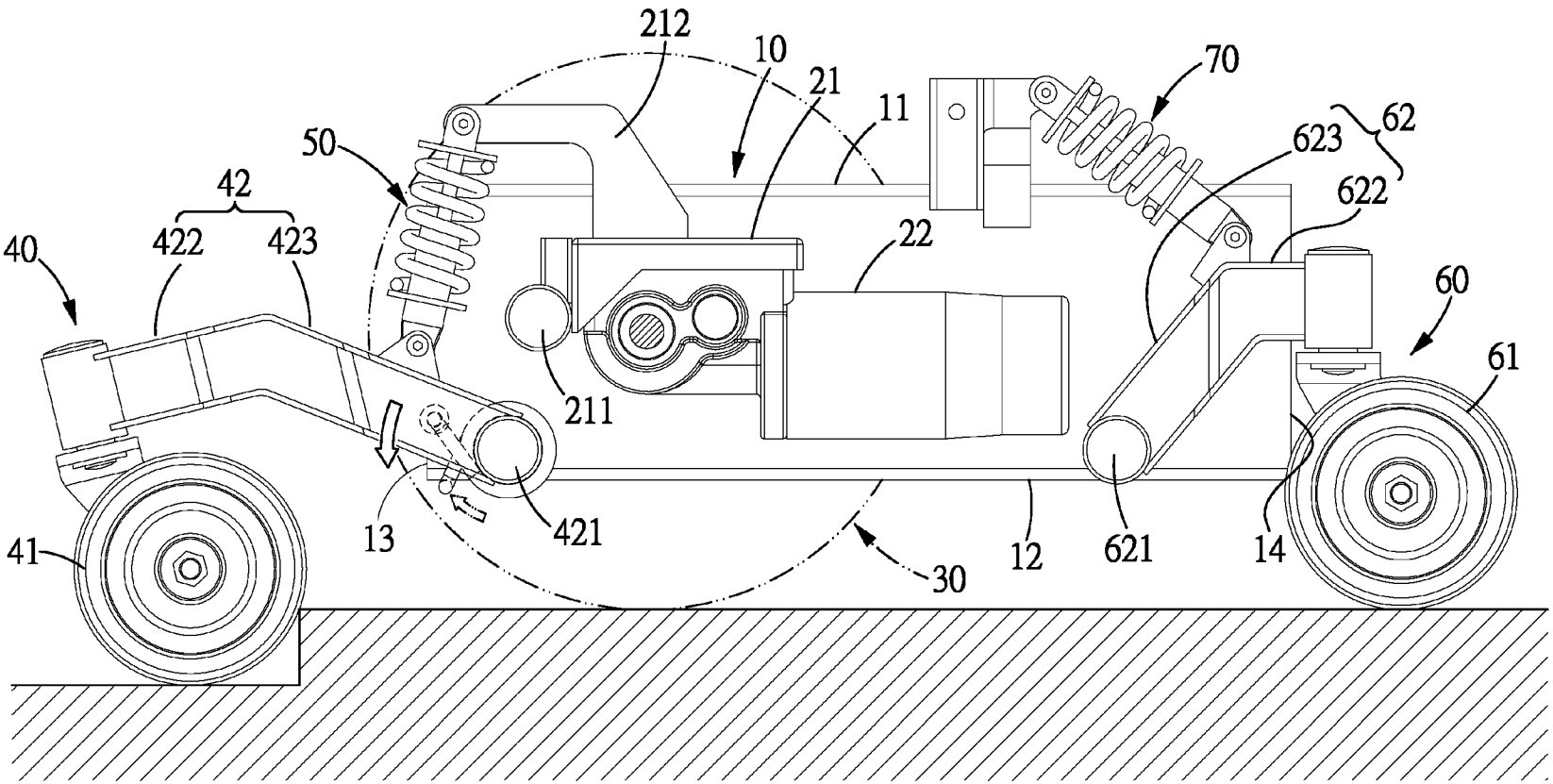
FIG. 8 shows that the suspension structure for the electric wheelchair in accordance with the present invention runs across a concave obstacle.

Referring then to FIGS. 6-8, when the suspension structure of the electric wheelchair in accordance with the present invention is placed on a horizontal bearing surface G, the drive wheels 30, the front guide wheels 41 and the anti-roll wheels 61 are all pressed against the ground.

When the suspension structure runs across a convex obstacle, as shown in FIG. 7, the drive wheels 30 will move the wheelchair forward until the front guide wheels 41 come into contact with the obstacle. At this moment, the drive force from the drive units 20 make the front guide wheels 41 drive the front suspension arms 42 to pivot upward around the front suspension arm pivot shaft 421, so that the front guide wheels 41 can easily climb the obstacle. Meanwhile, the pivoting motion of the front suspension arms 42 makes the torsion springs 43 compressed, so that, once the front guide wheels 41 climb onto the obstacle, the torsion springs 43 will press the front guide wheels 41 against the obstacle via the front suspension arms 42, so as to improve the grip of the front guide wheels 41.

The upward pivoting motion of the front suspension arm pivot shafts 421 also compress the front shock absorbers 50, then the front shock absorbers 50 push the bogies 21 to pivot toward the lower side 12 of the frame 10 by moving around the transmission pivot units 211, so that the front shock absorbers 50 absorb the upward pushing force from the front guide units 40, so as to prevent the frame 10 from rolling over backwards. After the front guide units 40 pass through the obstacle, the transmission devices 22 continue driving the front drive wheels 30 to rotate forward, meanwhile, the anti-roll units 60 compress and decompress the rear shock absorbers 70, making the rear suspension arms 62 pivot around the rear suspension arm pivot shafts 621 to change the position of the anti-roll wheels 61, so that the anti-roll wheels 61 can pass through the obstacle successfully.

When the suspension structure runs across a concave obstacle, as shown in FIG. 8, the drive wheels 30 will move the wheelchair forward until the front guide wheels 41 come into contact with the concave obstacle. At this moment, the front guide wheels 41 lower down to the surface of the obstacle which is at different heights with respect to the anti-roll wheels 61, the front shock absorbers 50 will extend to maintain the frame 10 and the anti-roll wheels 61 at their original height, so as to stabilize the wheelchair.

After lowering down to the surface of the obstacle, the front guide wheels 41 will drive the front suspension arms 42 to pivot downward around the front suspension arm pivot shafts 421, making the second front extension sections 423 of the front suspension arms 42 compress the torsion springs 43, then the torsion springs 43 push against the frame 10, making the frame 10 produce a reaction force toward the front suspension arms 42, ensuring that the frame 10 and the anti-roll units 60 are all truly pressed against the surface of the bearing surface G, and preventing the frame 10 from rolling over forward. The reaction force of the front guide units 40 and the anti-roll units 60 improves the grip performance while substantially reducing the possibility of rollover of the wheelchair. After the front guide units 40 successfully pass through the concave obstacle, the transmission devices 22 continue driving the drive wheels 30 to move forward, meanwhile, the anti-roll units 60 compress and decompress the rear shock absorbers 70, making the rear suspension arms 62 pivot around the rear suspension arm pivot shafts 621 to change the position of the anti-roll wheels 61, so that the anti-roll wheels 61 can pass through the obstacle successfully.

In general, when the front guide arms 42 drive the front guide wheels 41 to pivot, the torsion springs 43 can produce a reaction force to prevent the frame 10 from rolling over, improving safety. When the suspension structure runs across an uneven bumpy road, the front and rear shock absorbers 50, 70 can ease the shock imposed on the frame 10, enhancing sitting comfort.

While we have shown and described various embodiments in accordance with the present invention, it is clear to those skilled in the art that further embodiments may be made without departing from the scope of the present invention.

What is claimed is:

1. A suspension structure for an electric wheelchair, comprising:

a frame with an upper side, a lower side, a front end and a rear end, a chair seat mounted on the upper side, a direction extending from the front end to the rear end being defined as a first direction, and a direction perpendicular to the first direction being defined as a second direction; two drive units located at both sides of the frame and each including a bogie and a transmission device fixed to the bogie, one end of each of the bogies being pivoted to the frame via a transmission pivot unit, and each of the transmission devices extending toward another end of each of the bogies, the suspension structure being characterized in that:

each of the bogies is further provided with an assembling section extending along the second direction;

two drive wheels are connected to and rotated by the transmission devices;

two front guide units are located at both sides of the frame and each include a front guide wheel, a front suspension arm and a torsion spring, the front guide wheels are pivoted to one end of the front suspension arms, respectively, and another end of each of the front suspension arms is pivoted to the frame via a front suspension arm pivot shaft and located close to the front end, each of the torsion springs is sleeved onto the front suspension arm pivot shaft and has one end fixed to a corresponding one of the front suspension arms and another end abutted against the lower side close to the front end of the frame;

two front shock absorbers each have one end pivoted between the two ends of each of the front suspension arms and another pivoted to the assembling section of each of the bogies, and extend in a direction which has an angle with respect to the first direction;

two anti-roll units are located at both sides of the frame and each include an anti-roll wheel and a rear suspension arm, each of the anti-roll wheels is pivoted to one end of each of the rear suspension arms, and another end of each of the rear suspension arms is pivoted to the frame via a rear suspension arm pivot shaft; and two rear shock absorbers each have one end pivoted between two ends of each of the rear suspension arms and another end pivoted to the frame, and extend in a direction which has an angle with respect to the first direction.

2. The suspension structure for the electric wheelchair as claimed in claim 1, wherein a first front extension section and a second front extension section are formed between the two ends of each of the front suspension arms, the first front extension section extends along the first direction, and the second front extension section extends toward the lower side and defines an angle with respect to the first direction, each of the torsion springs has one end fixed to the second front extension section and another end abutted against the lower side close to the front end of the frame.

3. The suspension structure for the electric wheelchair as claimed in claim 1, wherein a first rear extension section and a second rear extension section are formed between two ends of each of the rear suspension arms, the first rear extension section extends in the first direction, and the second rear extension section extends toward the lower side of the frame and has an angle with respect to the first direction.

* * * * *